US010196824B2

(12) United States Patent
Tiirola

(10) Patent No.: US 10,196,824 B2
(45) Date of Patent: Feb. 5, 2019

(54) LINING BOARD, LINING PANEL AND METHOD FOR MANUFACTURING LINING BOARD

(71) Applicant: STOFIX OY, Oulunsalo (FI)

(72) Inventor: Samuli Tiirola, Puuppola (FI)

(73) Assignee: STOFIX OY, Oulunsalo (FI)

( * ) Notice: Subject to any disclaimer, the term of this patent is extended or adjusted under 35 U.S.C. 154(b) by 0 days.

(21) Appl. No.: 15/409,985

(22) Filed: Jan. 19, 2017

(65) Prior Publication Data

US 2017/0211279 A1 Jul. 27, 2017

(30) Foreign Application Priority Data

Jan. 22, 2016 (FI) ..... 20165040

(51) Int. Cl.
*E04F 13/08* (2006.01)

(52) U.S. Cl.
CPC ..... *E04F 13/0862* (2013.01); *E04F 13/0891* (2013.01)

(58) Field of Classification Search
CPC ..... E04F 13/0862; E04F 13/0891; E04F 13/0896; E04F 13/0885; E04F 13/0871; E04F 13/0873; E04F 13/0801; E04F 13/0803; B44C 1/28
USPC ..... 52/386, 426
See application file for complete search history.

(56) References Cited

U.S. PATENT DOCUMENTS 2,037,465 A * 4/1936 Gibson ..... E04F 13/141 52/316
2,088,625 A 8/1937 Wallace
2,293,331 A 8/1942 Dahlberg
2,938,376 A * 5/1960 Workman ..... E04F 13/0862 52/314
3,234,692 A 2/1966 Bierlich
3,863,417 A * 2/1975 Franchi ..... B63B 5/08 52/388
4,912,902 A * 4/1990 Weaver ..... B44C 1/28 52/314
6,408,585 B1 * 6/2002 Tajima ..... B44C 1/28 52/385
6,470,641 B1 * 10/2002 Faure ..... E04B 5/12 52/391
2004/0065035 A1 4/2004 De Vlam
2010/0086723 A1 4/2010 Blanke-Bohne et al.
(Continued)

FOREIGN PATENT DOCUMENTS

FI 117485 B 10/2006
GB 2457293 A 8/2009
(Continued)

OTHER PUBLICATIONS

May 11, 2017 Search Report issued in European Patent Application No. 17152247.

*Primary Examiner* — Brian D Mattei
(74) *Attorney, Agent, or Firm* — Oliff PLC

(57) ABSTRACT

A lining board includes lining tiles secured to each other with adhesive mass, the lining tiles having a front surface, a back surface as well as side surfaces between the front surface and back surface. There is at least one recess in at least one side surface of at least one lining tile of the lining board, filled with adhesive mass when the lining board was assembled. In addition, a lining tile and a method for manufacturing a lining board.

15 Claims, 3 Drawing Sheets

(56) References Cited

U.S. PATENT DOCUMENTS

| | | | | |
|---|---|---|---|---|
| 2010/0326010 | A1* | 12/2010 | Bouchard | E04F 13/0862 52/762 |
| 2012/0017528 | A1* | 1/2012 | Liu | E04F 13/0862 52/309.1 |
| 2012/0128941 | A1* | 5/2012 | Bisazza | B44C 1/28 428/156 |
| 2014/0069050 | A1* | 3/2014 | Bolin | E04C 2/26 52/745.21 |
| 2014/0260043 | A1* | 9/2014 | Cottier | E04F 13/0826 52/489.2 |
| 2015/0211236 | A1* | 7/2015 | Bowden | E04F 13/0885 428/41.8 |

FOREIGN PATENT DOCUMENTS

| | | | |
|---|---|---|---|
| GB | 2516054 | A | 1/2015 |
| WO | 03/046100 | A1 | 6/2003 |

* cited by examiner

LINING BOARD, LINING PANEL AND METHOD FOR MANUFACTURING LINING BOARD

BACKGROUND OF THE INVENTION

The invention relates to a lining board which comprises lining tiles secured to each other with adhesive mass, the lining tiles having a front surface, back surface, and side surfaces between the front surface and the back surface.

The invention further relates to a lining tile which comprises a front surface, back surface, and side surfaces between the front surface and back surface.

The invention further relates to a method for manufacturing a lining board, in which method lining tiles that form the front side of the lining board are placed side by side, said lining tiles comprising a front surface, back surface and side surfaces between the front surface and the back surface, and the lining tiles are secured to each other with adhesive mass.

Lining boards provided with lining tiles are used on the external cladding of a building to form the facade of the building. A lining board may be secured to a wall of a building with supports mounted in said wall, for example. FI publication 117485 discloses a method for manufacturing a front side board for external cladding of a building. In the method in question, the gaps between the lining tiles of the front side board are filled with sealing compound that secures the lining tiles to each other. The front side board put forth in said publication further includes a back-plate forming the frame structure of the front side board and having grip spikes that sink in the seams between the tiles and bind the tiling and the back sheet to each other to form a complete front side board.

BRIEF DESCRIPTION OF THE INVENTION

An object of the invention is to provide a novel lining board.

The lining board according to the invention is characterised in that at least one side surface of at least one lining tile of the lining board has at least one recess which has been filled with adhesive mass at the time the lining board was assembled.

The lining tile according to the invention is characterised in that at least one side surface of the lining tile has at least one recess which may be filled with adhesive mass that secures the lining tile.

The method according to the invention for manufacturing a lining board is characterised by forming at least one recess on at least one side surface of at least one lining tile of the lining board, the recess being adapted to fill up with adhesive mass when the lining tiles are being secured to each other by means of the adhesive mass.

In the solution put forth, the lining tiles are fixed to one another by means of adhesive mass fed to one or more recesses formed in one or more side surfaces of the lining tiles. With said recesses, it is possible to establish, on the back surface side of the lining tiles, a space or chamber between adjacent lining tiles, into which an adequate amount of adhesive mass may be fed to fix adjacent lining tiles securely to each other on the back surface side of the lining tiles. Due to the recesses, adjacent lining tiles may be installed very close to each other, whereby a lining board is created in which the distance between adjacent lining tiles may be set to be very small, but in which the securing of the lining tiles to each other is still firm, preventing, for example, the bending of individual lining tiles as a result of temperature variations. If the side edges of the lining tiles are perfectly straight, the lining tiles may even be installed directly on top of each other or the ends in a butt joint with respect to each other, whereby there is not necessarily any kind of gap between the lining tiles.

BRIEF DESCRIPTION OF THE DRAWINGS

The invention is now described in closer detail in connection with preferred embodiments and with reference to the accompanying drawings, in which.

DETAILED DESCRIPTION OF THE INVENTION

Figure 1:
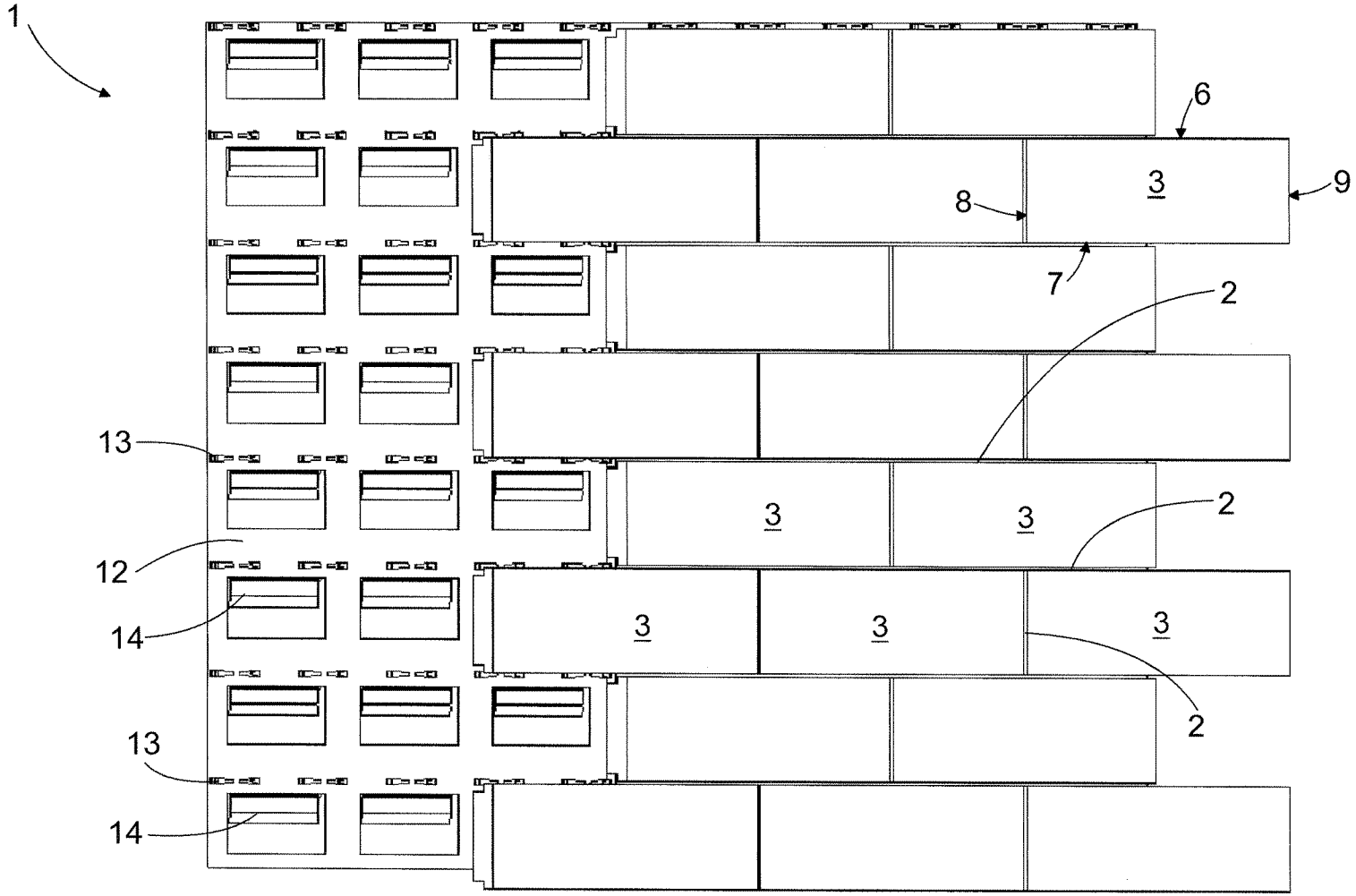
FIG. 1 is a schematic front view of a lining board.
Figure 2:
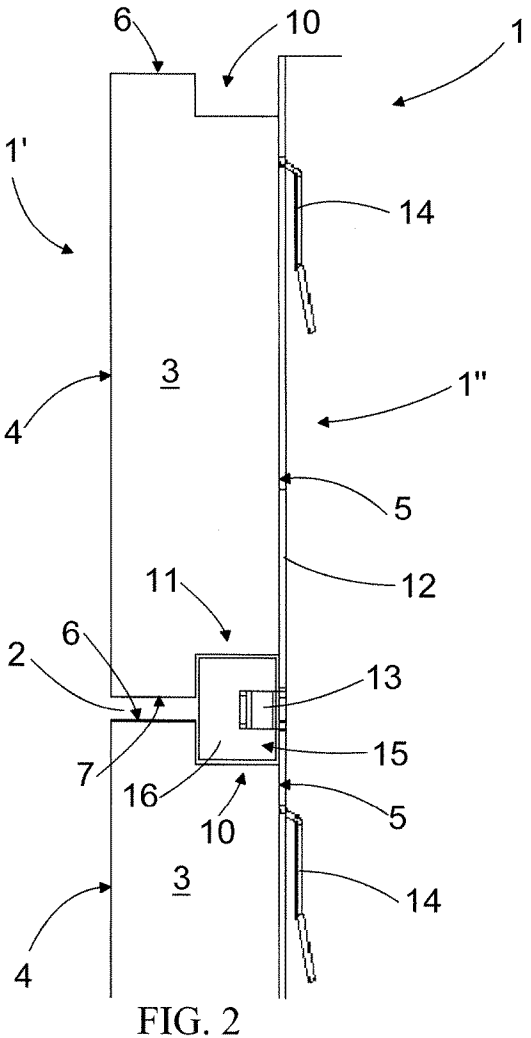
FIG. 2 shows schematically a side view of a part of a cross section of an embodiment of a lining board according to FIG. 1.
Figure 6:
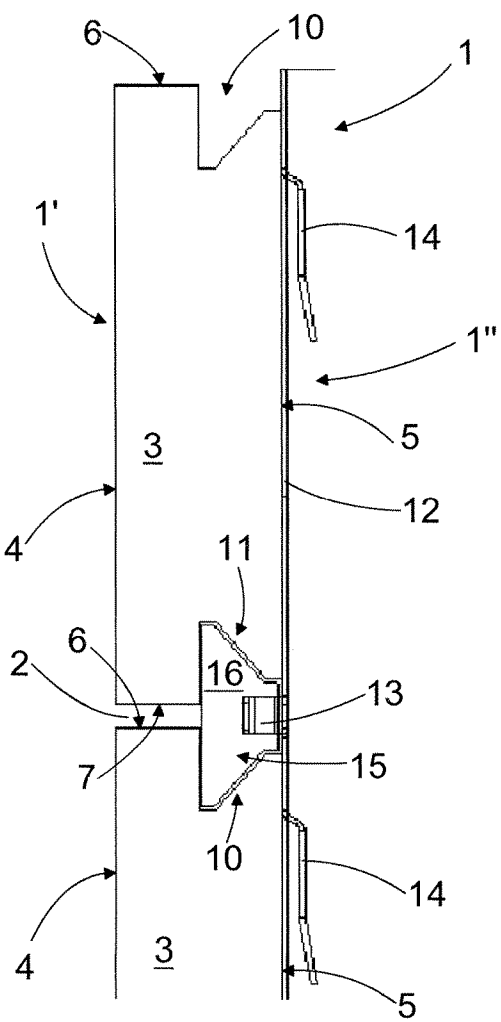
FIG. 6 shows schematically a side view of a part of a cross section of a fifth embodiment of a lining board according to FIG. 1, For the sake of clarity, the figures show some embodiments of the invention in a simplified manner. In the figures, like reference numerals identify like elements.
Figure 5:
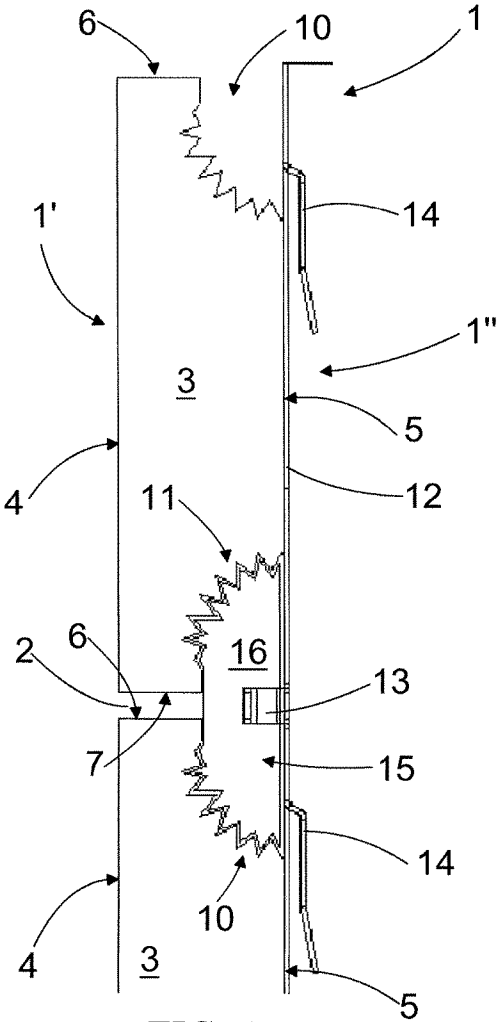
FIG. 5 shows schematically a side view of a part of a cross section of a fourth embodiment of a lining board according to FIG. 1.
Figure 4:
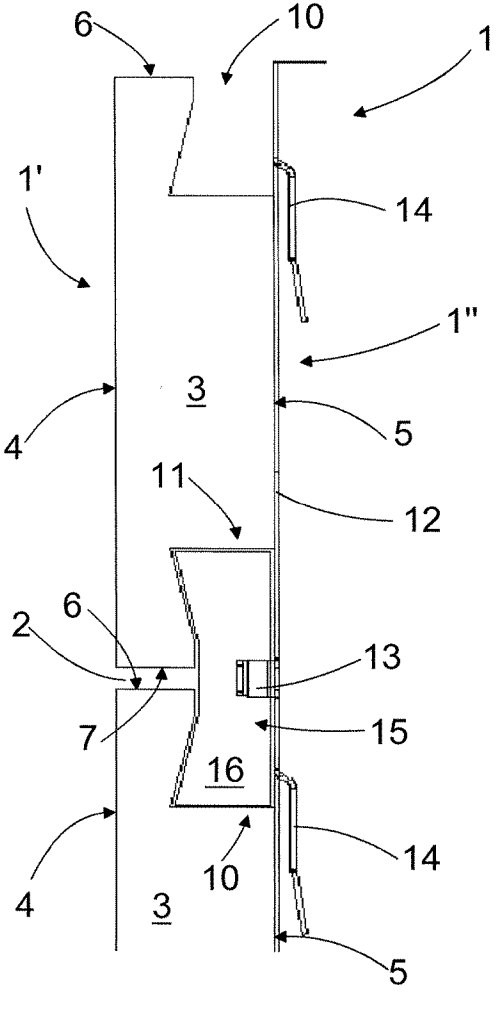
FIG. 4 shows schematically a side view of a part of a cross section of a third embodiment of a lining board according to FIG. 1.

FIG. 1 is a schematic front view showing a lining board 1. FIG. 2 is a schematic side view of a part of a cross section of an embodiment of a lining board 1 according to FIG. 1. For reasons of clarity, FIG. 2 does not show the cross section lines of the various parts of the lining board 1. The lining board 1 has a front side 1' oriented outward, that is, to be visible, and a back side 1" oriented inward, that is, invisible, when the lining board 1 is installed in place. The lining board 1 comprises lining tiles 3 placed side by side at a distance from each other, determined by the width of a gap 2. The lining tile 3 has a front surface 4 oriented outward so as to be visible, that is, in the direction of the front side 1' of the lining board 1, and a back surface 5 oriented inward so as to be invisible, that is, in the direction of the back side 1" of the lining board 1.

The lining tile 3 shown in FIGS. 1, 2, as well as the lining tiles 3 shown in FIGS. 3, 4, 5 and 6 below, is a rectangle in shape and has a first side surface 6, a second side surface 7, a third side surface 8, and a fourth side surface 9 between the front surface 4 and back surface 5. In the lining tile 3, the first side surface 6 and the second side surface 7 are additionally side surfaces oriented substantially in opposite directions in relation to each other, so side surfaces oriented away from each other, as are the third side surface 8 and the fourth side surface 9 side surfaces oriented substantially in opposite directions in relation to each other, so side surfaces oriented away from each other. In the lining tile 3, the first side surface 6 forms the upward top surface or top edge of the lining tile 3, the second side surface 7 forms the downward lower surface or lower edge of the lining tile 3, and the third side surface 8 and the fourth side surface 9 form the end surfaces or end edges of the lining tile 3.

The installation position of the lining tile 3 may also differ from the ones shown in the drawings, that is, the lining tile 3 may also be installed in a vertical or slanting position. The external appearance of a lining tile may also differ from the rectangle shape described. A lining tile may therefore also be, for example, triangular or a polygon other than a square, in other words, an angular lining tile may have three or more angles, and the number of the side surfaces of a lining tile varies according to the shape in question.

The lining tile 3 of FIG. 2, like lining tiles 3 shown in FIGS. 3, 4, 5, and 6 below, comprises a recess 10 in the first side surface 6 parallel to the side surface 6, in other words, in the longitudinal direction of the side surface 6, which is oriented from the first side surface 6 inward into the lining tile 3, said recess 10 being open outward from the first side surface 6. The recess 10 is formed by removing material from the first side surface 6 or by omitting material from the first side surface 6 so that the first side surface 6 is not substantially evenly continuous on the entire thickness of the lining tile 3, that is, on the distance between the front surface 4 and back surface 5 of the lining tile 3.

The second side surface 7 of the lining tile 3, in other words, the side surface 7 oriented substantially in the opposite direction in relation to side surface 6, has a recess 11 parallel to the side surface 7, that is, in the longitudinal direction of the side surface 7, which is oriented inward from the second side surface 7 into the lining tile 3, said recess 11 being open outward from the second side surface 7. The recess 11 may be formed in the same manner as the recess 10 in the first side surface 6.

In the thickness direction of the lining tile 3, that is, in the direction between the front surface 4 and back surface 5 of the lining tile 3, said recesses 10, 11 are adapted to extend all the way to the back surface 5 of the lining tile 3. In such a case, the dimension of the back surface 5 of the lining tile 3 in the vertical direction of FIG. 2, that is, in the direction between the side surfaces 6, 7 comprising the recesses 10, 11 in the lining tile 3, is smaller than the dimension of the front surface 4 of the lining tile 3 in the corresponding direction. It may also be determined in connection with the disclosed embodiment that the recesses 10, 11 are formed in the back surface 5 of the lining tile 3, in the edges 6, 7 of the lining tile, the recesses 10, 11 being adapted to extend towards the front surface 4 of the lining tile 3.

The lining tiles 3 of the drawings do not show the recesses corresponding to the recesses 10, 11 in the third side surface 8 or the fourth side surface 9 of the lining tile 3, but if so desired similar recesses may also be arranged in them. In at least one side surface of the lining tile 3, at least one recess is arranged, which is either a recess of the type of the recesses 10, 11 or a recess as described below. Because there may be various external shapes for the lining tiles 3, as described in the above, it may at the general level be determined that when one or more or even all of the side surfaces of the lining tile 3 comprise recesses 10, 11 extending all the way to the back surface 5 of the lining tile 3, as shown in FIG. 2, the dimension of the back surface 5 of the lining tile 3 is smaller in the direction of the side surface of the lining tile 3 that comprises the recess than the dimension of the front surface 4 of the lining tile 3 in the corresponding direction.

The opposite recesses 10, 11 of adjacent lining tiles 3, to be more precise those placed one on top the other in the vertical direction in the arrangement of the drawings, form a chamber 15 which is filled with adhesive mass 16 at the time the lining board 1 is assembled.

The lining board 1 further includes a back-plate 12, which may be a steel plate, for example. The back-plate 12 includes grippers 13, which are protrusions pointing in the direction 1' of the front side of the lining board 1, or in other words, towards the back surface 5 of the lining tile 3. Said grippers 13 may be separately fixed to the back-plate 12, but more preferably said grippers 13 are fixed portions of the back-plates 12 and formed of the back-plate 12, for example, by punching said portion with the exception of one edge off the back-plate 12 and by bending it in the shape of a protrusion of the desired shape.

Further, the back-plate 12 includes hangers 14, which are protrusions oriented in the direction of the back side 1" of the lining board 1, or in other words, oriented away from the back surface 5 of the lining tile 3. Said hangers 14 may be separately fixed to the back-plate 12, but more preferably said hangers 14 are fixed portions of the back-plates 12 and formed of the back-plate 12, for example, by punching said portion with the exception of one edge off the back-plate 12 and by bending it in the shape of a protrusion of the desired shape. When the lining board 1 is installed in place on a wall, the lining board 1 is placed by its hangers 14 on the wall to be supported by its supports fixed in the wall. Said hangers 14 may have a plurality of obvious implementations known per se to a person skilled in the art, which in this context will not be examined in any greater detail.

A lining board 1 is manufactured as follows. The lining tiles 3 are positioned on a manufacturing platform with their front surfaces 4 facing down, at a distance from each other determined by the desired gap 2. In said positioning, a meshy tiling guide, for example, may be utilised, having longitudinal and transverse rods that define the mutual positioning of the lining tiles 3. When a tiling guide is used, the lining tiles 3 may be put in place either by hand or automatically with the aid of a robot, for example. Alternatively, the positioning of the lining tiles 3 may be carried out automatically without a special tiling guide by means of a robot, only.

When all the lining tiles 3 included in the lining board 1 to be manufactured have been set in place, adhesive mass 16 is fed to the chamber 15 formed by the opposite recesses 10, 11 of the adjacent lining tiles 3, said adhesive mass 16, as it is curing, securing adjacent lining tiles 3 to each other. Such an amount of adhesive mass 16 is fed that once is has cured it substantially fills the chamber 15, but does not spread to the back surfaces of the lining tiles 3.

Before the adhesive mass 16 cures, the back-plate 12 is put in place so that the grippers 13 are positioned in the chambers 15 and embed in the adhesive mass 16 fed in said chambers 15. In such a case, the adhesive mass 16, as it is curing, secures the tiling formed by the lining tiles 3 into the back-plate 12 through the adhesive mass 16 and the grippers 13, the back-plate 12 thereby forming the frame structure of the lining board 1.

Figure 3:
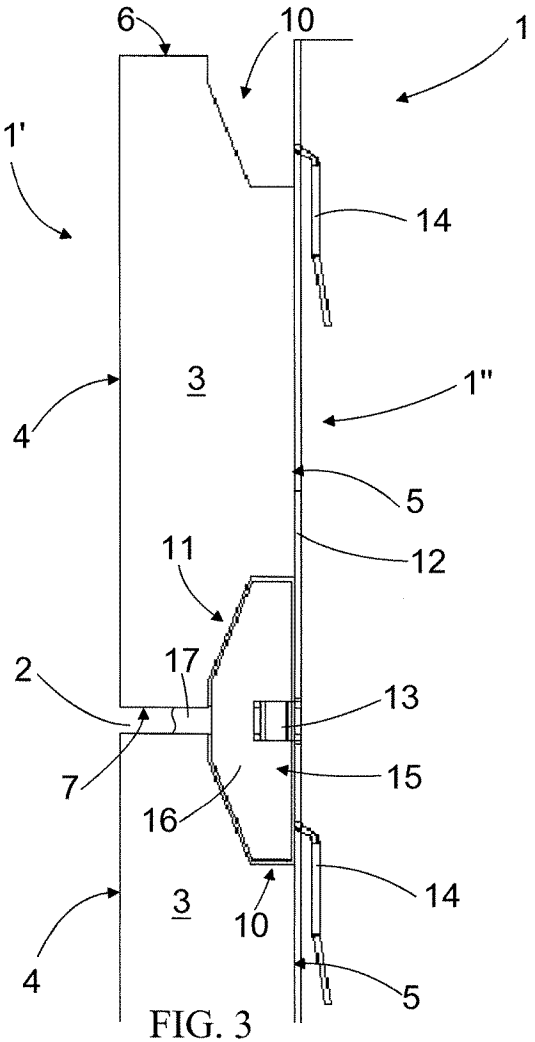
FIG. 3 shows schematically a side view of a part of a cross section of another embodiment of a lining board according to FIG. 1.

According to an embodiment, before the adhesive mass 16 is fed in, micro stone sprinkle 17 is fed in the gaps between the lining tiles 3, which comprises stone chips with a diameter of approximately 2 mm, for example. The micro stone sprinkle 17 prevents the adhesive mass from penetrating into the manufacturing platform of the lining board 1 and at the same time provides the bottom of the gap 2 with a tidy appearance. The micro stone sprinkle 17 is schematically shown in FIG. 3.

In the disclosed solution, the lining tiles 3 are secured to each other on the back side of the lining tiles 3 by means of adhesive mass 16 fed into recesses formed in the side surfaces of the lining tiles 3. With said recesses, a space, that is, a chamber 15 is created between adjacent lining tiles 3, into which a sufficient amount of adhesive mass 16 may be fed to firmly secure adjacent lining tiles 3 to each other, the edges of said recesses forming bonding surfaces in the lining tile 3 for the adhesive mass 16. Due to the disclosed recesses, adjacent lining tiles 3 may be installed very close to each other, whereby a lining board is created in which the distance between adjacent lining tiles may be set to be very small, but in which the securing of lining tiles to each other and the possible back-plate forming the back frame of the lining board is still firm, preventing, for example, the bending of individual brick tiles as a result of temperature variations. If the side surfaces of the lining tiles are perfectly straight, the lining tiles may even be installed directly on top of each other or the ends in a butt joint with respect to each other, whereby there is no gap between the lining tiles.

The solution set forth thus makes it possible to manufacture lining boards that have a strong and supportive structure, but with a most varied arrangement insofar as the external appearance of the lining tiles is concerned.

The recess 10, 11 formed in the side surface of the lining tile 3 may extend on a part of the length of said side surface, only. On the length of the side surface of the lining tile 3 there may be one or more separate local recesses in line with it, the direction of which may also differ from the longitudinal direction of the side surface. One or more or even all of said local recesses may form a chamber 15 for the gripper 13 to bind the tiling formed by the lining tiles 3 to the back-plate. Preferably, however, the recess 10, 11 is adapted to extend on the entire length of the side surface, whereby the lining tile 3 is most firmly secured in place.

In the embodiment shown in FIG. 2, the cross section of the recesses 10, 11 is rectangular. By changing the transverse profile of the recesses 10, 11, the size of the surface area of the sides of the recesses formed in the lining tile 3 may be affected, that is, the size of the surface area which in the lining tile 3 forms the bonding surfaces for the adhesive mass 16. FIGS. 3 to 6 illustrate alternative embodiments for the cross sections of the recesses 10, 11, but other embodiments for the cross sections of the recesses 10, 11 are also possible. For reasons of clarity, FIGS. 3 to 6 do not show the cross section lines of the various parts of the lining board 1.

In the embodiments of FIGS. 2 to 6, the side surfaces 6, 7 directed towards each other in the vertically adjacent lining tiles 3 both comprise recesses 10, 11 directed towards each other, in other words in the adherence of the side surfaces directed towards each other in two adjacent lining tiles, the side surfaces of both lining tiles have at least one recess 10, 11, which when positioned substantially opposite each other together form a chamber 15 for the adhesive mass 16. The lining tile 3 itself, in such a case, has recesses 10, 11 in the side surfaces 6, 7 directed in opposite directions in the lining tiles 3 with respect to each other, whereby each lining tile 3 is firmly secured to the adjacent lining tiles 3 so that individual lining tiles may not bend as a result of temperature variations, for example.

According to an embodiment, only one of the side surfaces 6, 7 directed towards each other in the adjacent lining tiles 3 has the recess 10, 11. In other words, in this embodiment, in the adherence of the side surfaces directed towards each other in two adjacent lining tiles 3, the side surface of only one lining tile 3 has the recess 10 or 11, whereby in said adherence the recess 10, 11 in only one of the lining tiles 3 forms the chamber 15 for the adhesive mass 16, and the binding of the adhesive mass 16 to the lining tile 3 without the recess 10, 11 takes place on the side surface without the recess 10,11 in the lining tile 3 in question. In such an embodiment, the securing in place of the lining tiles 3 does not necessarily always take place as firmly as in the embodiments shown in the drawings. In such a case, an implementation of the lining board 1 is also possible where only some of the lining tiles 3 of the lining board 1 have recesses 10, 11.

According to an embodiment, a side surface 6, 7, 8, 9 of the lining tile 3 may comprise in said side surface, on the portion between the front surface 4 and back surface 5, a recess which is directed inward to the lining tile 3 from said side surface 6, said recess being open outward but not extending all the way to the back surface 5 of the lining tile 3. An example of such a recess is a groove formed in the side surface of the lining tile 3 in the longitudinal direction of the side surface. In such a case, when adhesive mass 16 is being fed, the adhesive mass 16 is fed in the gap between adjacent lining tiles 3 so that said recess/said recesses and said gap from the back surface of the lining tile all the way to said gaps is filled with the adhesive mass. This embodiment, too, has the alternative where only one of the side surfaces positioned opposite each other in the adjacent lining tiles comprises a recess. If such a recess solution is applied, a gap always needs to be left between the lining tiles between the side surfaces where the adhesive mass is fed.

According to an embodiment, a lining board 1 does not comprise a back-plate 12, but lining tiles 3 secured to each other with adhesive mass 16, only. In such a case, the lining board 1 may be secured to supports fixed in a building wall with screws drilled through the lining board, or hangers embedded in adhesive mass on the back side of the lining board.

A lining tile may be a brick sheet, for example. The brick sheet may be a burnt brick sheet. Due to the burning process of a burnt brick sheet, the sides or edges of the brick sheet may not necessarily be entirely straight. When burnt brick sheets are used, the gap between adjacent brick sheets may be from 1 to 6 mm wide, only, which is considerably less than in lining boards imitating typical masonry facings, in which the seam width between adjacent brick sheets is typically from 10 to 13 mm.

A brick sheet may also be a cut brick sheet. In a cut brick sheet, the sides or edges of the brick sheet may even be perfectly straight. In such a case, the lining tiles may even be installed directly on top of each other or the ends in a butt joint with respect to each other, whereby there is not necessarily any kind of gap between the lining tiles unless the specific aim is to leave one there.

A lining tile may be a lining stone tile, for example. The sides or edges of a lining stone tile may either have been sawn perfectly straight or their straightness may differ, whereby the lining stone tiles may be installed directly on top of each other or the ends in a butt joint with respect to each other, or a narrow gap may be left between them.

A lining tile may also be a plastic tile, whereby the sides or edges of the lining tile may be perfectly straight or their straightness may have been made to differ on purpose. The front surface of a plastic tile may also be provided with a pattern or profile imitating a brick tile or a lining stone tile.

A lining tile may also be a clinker tile, whereby the sides or edges of the lining tile may be perfectly straight or their straightness may vary.

A lining board implemented with brick tiles, lining stone tiles, or clinker tiles may be used as front side lining boards of outer walls of buildings, or as internal lining boards of the indoor walls of a building. A lining board implemented with plastic tiles may also be used as the front side lining boards of building outer walls, but due to its light weight it is particularly well suited for use as a lining board of light-weight indoor walls.

As adhesive mass, cement-based grout, cement or epoxy based jointing mortars or plastic pastes may be used. To fasten brick and lining stone tiles, grout, jointing mortars, or plastic pastes may be used. Plastic pastes may be best suited for fastening plastic tiles, but the use of grout or jointing mortar to fasten plastic tiles is also possible.

A person skilled in the art will find it obvious that, as technology advances, the basic idea of the invention may be implemented in many different ways. The invention and its embodiments are thus not restricted to the above-described examples but may vary within the scope of the claims.

The invention claimed is:

1. A lining board, comprising:

a back-plate comprising:

hangers including protrusions formed of the back plate, the hangers protruding to a back side of the back plate, and grippers protruding to a front side of the back plate in a direction opposite the hangers; and lining tiles secured to each other and to the back-plate with adhesive mass, the lining tiles have a front surface, a back surface as well as side surfaces between the front surface and the back surface, and wherein at least one lining tile of the lining board has at least one side surface with at least one recess which is filled with the adhesive mass, wherein the grippers are directed towards the back surface of the lining tiles and embedded in the adhesive mass between adjacent lining tiles so that the grippers do not contact the at least one lining tile.

2. A lining board as claimed in claim 1, wherein at least two side surfaces that are directed substantially away from each other in the lining tile have at least one recess which is in the direction of the side surface and filled with the adhesive mass.

3. A lining board as claimed in claim 1, wherein the at least one recess in the at least one side surface of the lining tile extends to the back surface of the lining tile.

4. A lining board as claimed in claim 1, wherein the at least one recess in the at least one side surface of the lining tile extends on the entire length of the side surface of the lining tile.

5. A lining board as claimed in claim 1, wherein side surfaces directed towards each other in two adjacent lining tiles are adhered to each other, and, in the adherence of the side surfaces, there is at least one recess in the side surface of at least one of the adjacent lining tiles.

6. A lining board as claimed in claim 1, wherein side surfaces directed towards each other in two adjacent lining tiles are adhered and there is at least one recess in the side surfaces of both the adjacent lining tiles.

7. A lining board as claimed in claim 1, wherein the grippers comprise portions punched out of the back plate except for one edge, the portions being connected to the back plate at the one edge adjacent to holes formed in the back plate from where the portions were punched.

8. The lining board as claimed in claim 1, wherein the protrusions are portions of the back plate punched out of the back plate except for one edge, the portions being bent to the back side at the one edge adjacent to holes formed in the back plate from where the portions were punched.

9. The lining board as claimed in claim 1, wherein the at least one side surface is adjacent the front surface, the at least one recess includes an inclined surface spaced from the front surface, the inclined surface extending from a side of the lining tile away from the back surface and toward an opposite side of the tile forming an acute angle with the back surface, and the inclined surface is laterally recessed relative to the at least one side surface.

10. The lining board as claimed in claim 9, wherein the inclined surface is spaced from the back surface and positioned between the front surface and the back surface.

11. A method for manufacturing a lining board, the method comprising:

forming hangers in a back plate of the lining board that protrude from a back side of the back plate, the hangers including protrusions that are formed of the back plate, forming grippers in the back plate that protrude from a front side of the back plate in a direction opposite the hangers, positioning side by side lining tiles forming the front side of the lining board, the lining tiles comprising a front surface, a back surface as well as side surfaces between the front surface and back surface, and securing the lining tiles to each other and to a back-plate of the lining board by means of adhesive mass and the grippers, wherein at least one recess is formed in at least one side surface of at least one lining tile of the lining board, the recess is filled with the adhesive mass as the lining tiles are secured to each other by means of the adhesive mass, and the grippers are directed towards the back surface of the lining tiles and are embedded in the adhesive mass between adjacent lining tiles so that the grippers do not contact the lining tiles.

12. The method as claimed in claim 11, wherein forming the grippers comprises punching out portions of the back plate except for one edge of the portions and bending the portions at the one edge to the front side of the back plate.

13. The method as claimed in claim 11, wherein forming the hangers comprises punching the protrusions out portions of the back plate except for one edge of the portions and bending the portions at the one edge to the back side of the back plate to form the protrusions.

14. The method as claimed in claim 11, wherein the at least one side surface is adjacent the front surface, the at least one recess includes an inclined surface spaced from the front surface, the inclined surface extending from a side of the lining tile away from the back surface and toward an opposite side of the tile forming an acute angle with the back surface, and the inclined surface is laterally recessed relative to the at least one side surface.

15. The method as claimed in claim 14, wherein the inclined surface is spaced from the back surface and positioned between the front surface and the back surface.

* * * * *